US010584424B2

(12) United States Patent
Shu et al.

(10) Patent No.: US 10,584,424 B2
(45) Date of Patent: Mar. 10, 2020

(54) PROCESS FOR PREPARING LEAD BY ELECTROREDUCTION WITH AMMONIUM SULFATE AND AMMONIA

(71) Applicant: Xiangyun Tenglong Investment Co., Ltd., Dali (CN)

(72) Inventors: Yuzhang Shu, Dali (CN); Long Yang, Dali (CN); Rongxiang Liu, Dali (CN)

(73) Assignee: XIANGYUN TENGLONG INVESTMENT CO., LTD., Dali (CN)

( * ) Notice: Subject to any disclaimer, the term of this patent is extended or adjusted under 35 U.S.C. 154(b) by 0 days.

(21) Appl. No.: 16/318,712

(22) PCT Filed: Jul. 10, 2017

(86) PCT No.: PCT/CN2017/092332

§ 371 (c)(1),
(2) Date: Jan. 18, 2019

(87) PCT Pub. No.: WO2018/014747

PCT Pub. Date: Jan. 25, 2018

(65) Prior Publication Data

US 2019/0242022 A1 Aug. 8, 2019

(30) Foreign Application Priority Data

Jul. 19, 2016 (CN) ..... 2016 1 0569036

(51) Int. Cl.
*C25C 3/00* (2006.01)
*C25C 1/00* (2006.01)
(Continued)

(52) U.S. Cl.
CPC ..... *C25C 1/18* (2013.01)

(58) Field of Classification Search
CPC .... C25C 3/00; C25C 1/00; C25C 1/18; C25C 7/02; C25C 7/00
See application file for complete search history.

(56) References Cited

U.S. PATENT DOCUMENTS 4,118,219 A 10/1978 Elmore et al.
5,211,818 A 5/1993 Moure, Jr. et al.

FOREIGN PATENT DOCUMENTS

CN 85200287 U 11/1985
CN 1470675 A 1/2004
(Continued)

*Primary Examiner* — Zulmariam Mendez
(74) *Attorney, Agent, or Firm* — Bayramoglu Law Offices LLC

(57) ABSTRACT

A process for preparing lead by electroreduction with ammonium sulfate and ammonia is provided. In the process, an ammonium sulfate aqueous solution is used as an electrolyte, a lead compound is used as a raw material, titanium is used as an anode, stainless steel or lead is used as a cathode, and a direct-current electric field is applied in an electrolytic bath; the lead compound is reduced to metal lead after obtaining electrons at the cathode; and at the anode, ammonia is oxidized to nitrogen for escaping, and $H^+$ ions are generated simultaneously; sulfate radical ions and chloride ions in the lead compound enter the solution and react with the ammonia water to form ammonium sulfate and ammonium chloride; and the lead monoxide and lead dioxide in the lead compound are reduced to a metal lead and $OH^-$ ions are released to combine with the $H^+$ ions to form water.

14 Claims, 1 Drawing Sheet

(51) Int. Cl.
*C25C 7/02* (2006.01)
*C25C 1/18* (2006.01)

(56) References Cited

FOREIGN PATENT DOCUMENTS

| | | | |
|---|---|---|---|
| CN | 101335370 | A | 12/2008 |
| CN | 101368280 | A | 2/2009 |
| CN | 102296325 | A | 12/2011 |
| CN | 104711637 | A | 6/2015 |
| CN | 106065485 | A | 11/2016 |

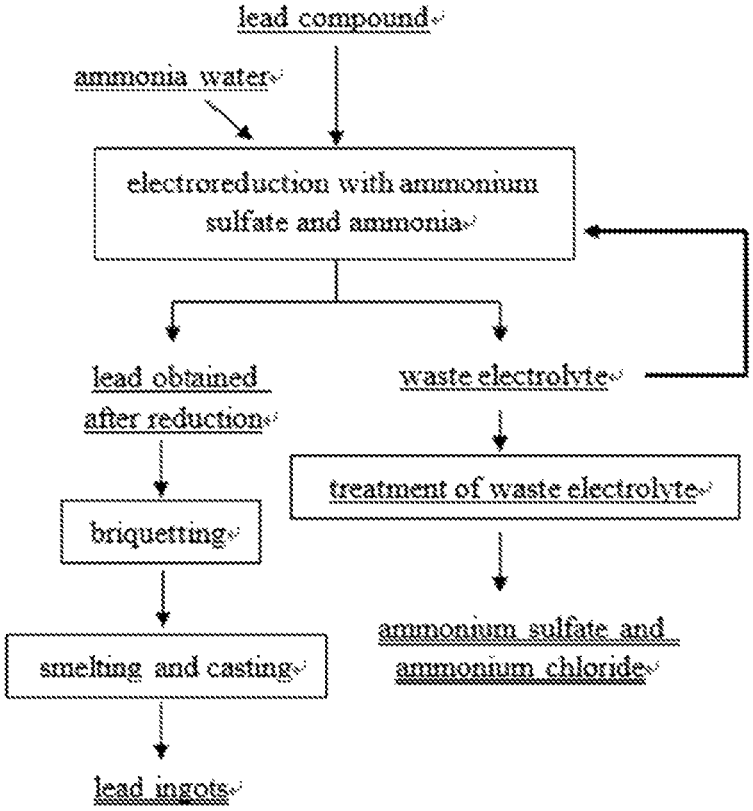
lead compound
ammonia water
electroreduction with ammonium sulfate and ammonia
lead obtained after reduction
waste electrolyte
briquetting
treatment of waste electrolyte
smelting and casting
ammonium sulfate and ammonium chloride
lead ingots

PROCESS FOR PREPARING LEAD BY ELECTROREDUCTION WITH AMMONIUM SULFATE AND AMMONIA

CROSS REFERENCE TO RELATED APPLICATIONS

This application is the national phase entry of International Application No. PCT/CN2017/092332, filed on Jul. 10, 2017, which is based upon and claims priority to Chinese Patent Application No. 201610569036.0, filed on Jul. 19, 2016, the entire contents of which are incorporated herein by reference.

TECHNICAL FIELD

The present invention belongs to the hydrometallurgical process technology, and particularly relates to a process for preparing lead by electroreduction with ammonium sulfate and ammonia.

BACKGROUND

At present, more than 80% of the use of lead is for lead-acid batteries. With the popularization of automobiles and the development of new energy industries, the use of lead-acid batteries is increasing, and the scrapped lead-acid batteries are mounting. Metallurgical researchers and environmentalists have done extensive research on how to dispose waste batteries in a simple, economical, scientific and environmental way. Especially, in the face of increasingly stringent environmental requirements, the wet smelting of lead is imperative. The technology of dismantling waste batteries has developed rapidly. The breakage and dismantling of batteries have achieved large-scale modern production. The plastic boxes and conductive grid materials are effectively recycled. However, the lead treatment of lead paste/mud of the battery is still performed by fire smelting. The lead in the lead paste/mud mainly includes $PbSO_4$, $PbO_2$, PbO, and a small amount of metal lead; and the other additives added when manufacturing the batteries, such as barium sulfate, carbon core and organic additives, are also included in the lead paste/mud. When the lead paste/mud is treated by the fire method, harmful substances such as lead dust, sulfur dioxide, and dioxins are inevitably generated to cause serious pollution to the environment. The clean and environment-friendly treatment of lead paste/mud is still an urgent issue to be solved.

For this purpose, a lot of research has been carried out to try to replace the fire treatment method with an environment-friendly and economical hydrometallurgical method. However, due to the complex phase composition of the paste/mud, currently, there is no wet treatment method that can compete with the fire method in terms of economy, cost, energy consumption and environment protection. Therefore, the treatment of lead paste/mud is still achieved by the fire smelting process; and some of the treatment processes include the desulfurization with ammonium bicarbonate or sodium alkali prior to the smelting by the fire method, and then the reduction and smelting are performed using the fire method.

A lot of research has been done on the wet treatment of lead paste/mud. The wet treatment of lead paste/mud mainly includes three methods. The first method is a solid phase reduction method, which is represented by the solid phase electrolysis researched by Keyuan Lu et al, Institute of Chemical Metallurgy, Chinese Academy of Sciences, and the characteristic of this method is that the electrolysis is carried out in a NaOH solution, including the following steps. First, the paste/mud is converted with NaOH (electrolytic residue), specifically the $PbSO_4$ is converted into $Pb(OH)_2$ and sodium sulfate, and after the conversion, the converted lead paste/mud is dehydrated and then coated onto a special cathode plate; then $PbO_2$, $Pb(OH)_2$, and PbO are reduced to metal lead at the cathode, and $O_2$ is generated at the anode; and the solution containing sodium sulfate is discharged after being treated. The second method is an electrowinning method, which is mainly characterized in that, the lead is dissolved to form a soluble lead salt solution, and a direct current is passed through the electrolytic bath; the lead in the solution is precipitated at the cathode, and oxygen and $PbO_2$ are generated at the anode. The electrolyte solution used is silicofluoric acid, borofluoric acid, sodium hydroxide solution, perchloric acid solution, etc. The third method is to make lead paste/mud into lead compounds, such as lead oxide, lead chloride, etc.

The above various wet treatment methods for treating the paste/mud of waste lead battery are economically impossible to compete with the current fire smelting process. Therefore, the treatment of lead paste/mud, at home and abroad, is still achieved by using the fire smelting method.

In addition, the raw materials and the secondary resource of zinc for smelting zinc by wet treatment method contain lead, and this lead eventually remains in the zinc leaching slag in a form of lead sulfate. At present, such materials are smelted by fire method to recover the lead from them, which not only consumes high energy, but also causes serious pollution to the environment due to the generated harmful substances such as lead dust, sulfur dioxide and dioxins during the smelting process.

SUMMARY

The present invention belongs to the hydrometallurgical process technology, and provides a process for preparing lead by electroreduction with ammonium sulfate and ammonia. Specifically, in the process, an ammonium sulfate aqueous solution is used as an electrolyte, a lead compound is used as a raw material, titanium is used as an anode, stainless steel or lead is used as a cathode, and a direct-current electric field is applied in an electrolytic bath; the lead compound is reduced to metal lead after obtaining electrons at the cathode; and at the anode, ammonia is oxidized to nitrogen for escaping, and $H^+$ ions are generated simultaneously; sulfate radical ions and chloride ions in the lead compound enter the solution and react with the added ammonia water to form ammonium sulfate and ammonium chloride; and the lead monoxide and lead dioxide in the lead compound are reduced to a metal lead, and $OH^-$ ions are released simultaneously to combine with the $H^+$ ions generated at the anode to form water. Wherein, the lead compound includes lead chloride, lead sulfate, lead monoxide, lead dioxide and mixtures thereof such as paste/mud of waste lead battery or other materials. This process is different from the existing electrolysis process and electrowinning process. In this process, the electrolyte does not contain lead, and the lead compound is directly reduced to metal lead at the cathode.

As a preferred technical solution, the process includes the following steps:

(1) loading: loading the lead material on a cathode frame;

(2) preparation of an electrolyte: adjusting a concentration of the electrolyte;

(3) reduction: applying a direct-current electric field in the electrolytic bath, so that the lead compound is directly reduced to a metal lead after obtaining electrons at the cathode, and $H^+$ ions are generated at the anode during the reduction process of lead, resulting in that the pH value of the solution is decreased; and then adding ammonia water to control the pH value of the solution;

(4) taking out from the electrolytic bath: after completing the reduction, lifting the cathode and taking out the lead obtained after reduction;

(5) briquetting: briquetting the lead obtained after reduction to remove the moisture from the lead;

(6) smelting, casting, and ingotting: smelting, casting, and ingotting the lead briquettes into products; and (7) treatment of waste electrolyte: recovering sulfate radical and chloride ions released from the lead compound at the cathode in the form of ammonium sulfate or ammonium chloride.

As a preferred technical solution, the lead material includes lead chloride, lead sulfate, lead monoxide, lead dioxide and mixtures thereof, such as paste/mud of the waste lead batteries. The paste/mud of the waste lead batteries is a mixture of metal lead, lead monoxide, lead dioxide and lead sulfate.

As a preferred technical solution, the electrolyte is ammonium sulfate.

As a preferred technical solution, the anode plate includes a titanium mesh, and the cathode plate includes a stainless steel plate or a lead plate.

As a preferred technical solution, the titanium mesh is a titanium mesh coated with an iridium-ruthenium coating.

As a preferred technical solution, the ammonium sulfate has a concentration of 0.5-4 mol/L.

As a preferred technical solution, in the step (3), the voltage for the reduction is 2.0-2.7 V, the current density is 100-500 $A/m^2$, and the pH is controlled to 6-9 with ammonia water.

As a preferred technical solution, the solution after electrolysis in the step (7) includes an ammonium sulfate solution.

The related chemical reaction equations in the process of reduction are as follows:

Anode Reaction:

$$2NH_3\text{-}6e^-=N_2\uparrow+6H^+$$

Main Cathode Reactions:

$$PbSO_4+2e^-=Pb+SO_4^{2-}$$

$$PbO+H_2O+2e^-=Pb+2OH^-$$

$$PbO_2+2H_2O+4e^-=Pb+4OH^-$$

$$PbCl_2+2e^-=Pb+2Cl^-$$

The advantages of the present invention are as follows.

1. The whole wet process is used, and harmful gases such as lead dust, lead fumes, sulfur dioxide fumes, dioxins, etc. that are always generated in the fire smelting will not be produced. The whole wet process is environment-friendly and has no environmental pollution problems.

2. The solids are directly reduced, without necessity of desulfurization, conversion and other processes, thereby shortening the process, and greatly reducing investment and production costs.

3. No additives need to be added during the electroreduction process.

4. No lead is contained in the electrolyte, and the waste electrolyte is easily processed, which can be concentrated and crystallized to produce ammonium sulfate or ammonium chloride.

5. The whole process of electroreduction is carried out at room temperature, with low energy consumption and good operating environment.

6. The solution in the whole process of electroreduction is neutral or slightly alkaline, which is less corrosive to equipment.

7. Solids are directly reduced by electroreduction. The voltage for reduction is low, the current density is high, with anode current density up to 400 $A/m^2$, and the electric energy consumption is low. When the raw material is divalent lead (lead chloride, lead sulfate, lead monoxide), the electricity consumption per ton of lead is 520-650 kWh; when the raw material is paste/mud of lead-acid batteries, the electricity consumption per ton of lead is 800-1100 kWh.

8. The lead recovery rate is over 99%, which can be used for large-scale production.

BRIEF DESCRIPTION OF THE DRAWINGS

In order to illustrate the embodiments of the present invention or the technical solutions in the prior art more clearly, a brief introduction to the drawings required in the illustration of the embodiments or the prior art is presented below. Apparently, the drawings described below are merely some of the embodiments of the present invention, for those of ordinary skill in the art, other drawings may be derived according to these drawings without creative efforts.

FIG. 1 is a process flow diagram of an embodiment of a process for preparing lead by electroreduction with ammonium sulfate and ammonia in the present invention.

DETAILED DESCRIPTION OF THE EMBODIMENTS

In order to further illustrate the present invention, the following illustration is made with reference to the drawings.

A process for preparing lead by electroreduction with ammonium sulfate and ammonia is provided, which obtains metal lead by electroreduction. Specifically, it is a method for directly reducing lead compound at the cathode of the electrolytic bath to obtain metal lead, using ammonium sulfate as electrolyte. Wherein, the lead compound includes lead chloride, lead sulfate, lead oxide, lead dioxide and mixtures thereof such as paste/mud of waste lead battery or other materials; and the electrolytic bath includes an anode plate, a cathode plate, and a material layer.

The process includes the following steps:

(1) loading: the lead material is loaded on a cathode frame;

(2) preparation of an electrolyte: a concentration of the electrolyte is adjusted;

(3) reduction: a direct-current electric field is applied in the electrolytic bath; the lead compound is directly reduced to the metal lead after obtaining electrons at the cathode, and $H^+$ ions are generated at the anode during the reduction process of lead, resulting in that the pH value of the solution is decreased; and then ammonia water is added to control the pH value of the solution;

(4) taking out from the electrolytic bath: when the reduction is completed, the cathode is lifted and the lead obtained after reduction is taken out;

(5) briquetting: the lead obtained after reduction is subjected to a process of briquetting to remove the moisture from the lead;

(6) smelting, casting, and ingotting: the lead briquettes are smelted, casted, and ingoted into products; and (7) treatment of waste electrolyte: sulfate radical ions and chloride ions of the lead compound are recovered in the form of ammonium sulfate or ammonium chloride.

The lead compound includes lead chloride, lead sulfate, lead oxide, lead dioxide and mixtures thereof such as paste/mud of waste lead battery or other materials.

The electrolyte is ammonium sulfate.

The anode plate includes a titanium mesh, and the cathode plate includes a stainless steel plate or a lead plate.

The titanium mesh is a titanium mesh coated with an iridium-ruthenium coating.

The ammonium sulfate has a concentration of 0.5-4 mol/L.

In the step (3), the voltage for the reduction is 2.0-2.7 V, the current density is 100-500 A/m$^2$, and the pH is controlled to 6-9 with ammonia water.

The solution after the reduction in the step (7) includes an ammonium sulfate solution.

Embodiment 1

(1) 500 g lead paste of waste lead-acid batteries, containing 75.04% Pb (including 5.2% Pb, 41.06% $PbSO_4$, 44.32% $PbO_2$, and 3.65% PbO), is taken;

(2) two pieces of titanium mesh coated with iridium-ruthenium coating are taken as an anode, and the anode has a width of 10 cm and a height of 20 cm;

(3) a piece of stainless steel is taken as a cathode, and the cathode has a width of 10 cm and a height of 20 cm;

(4) preparation of a pre-electrolyte: 5 L of 2 mol/L ammonium sulfate solution is prepared, and 200 mL of ammonia water is added;

(5) reduction: the reduction reaction is carried out in a constant pressure mode with a voltage of 2.3 V for 24 hours; the pH is controlled to 8-9 with ammonia water; and when the reduction is completed, the lead obtained after reduction is taken out from the electrolytic bath; and (6) the lead obtained after reduction subjected to the process of briquetting has a weight of 379.8 g, and the analysis result of the lead sample shows the content of Pb is 98.6%.

Main technical indicators are as follows: the initial current is 10.5 A, the peak current is 20.5 A, the electricity consumption of the reduction is 377.5 Wh, the electricity consumption per ton of lead is 1006 kWh, the anode current density is 250-500 A/m$^2$, the lead recovery rate is 99.4%, and the ammonia water consumption is 310 mL (containing 25%-28% of $NH_3$).

Embodiment 2

(1) 500 g lead paste of waste lead-acid batteries, containing 75.04% Pb (including 5.2% Pb, 41.06% $PbSO_4$, 44.32% $PbO_2$, and 3.65% PbO), is taken;

(2) two pieces of titanium mesh coated with iridium-ruthenium coating are taken as an anode, and the anode has a width of 10 cm and a height of 20 cm;

(3) a piece of stainless steel is taken as a cathode, and the cathode has a width of 10 cm and a height of 20 cm;

(4) preparation of a pre-electrolyte: 5 L of 2 mol/L ammonium sulfate solution is prepared, and 200 mL of ammonia water is added;

(5) reduction: the reduction reaction is carried out in a constant pressure mode with a voltage of 2.5 V for 20 hours; the pH is controlled to 8-9 with ammonia water; and when the reduction is completed, the lead obtained after reduction is taken out from the electrolytic bath; and (6) the lead obtained after reduction subjected to the process of briquetting has a weight of 380.1 g, and the analysis result of the lead sample shows the content of Pb is 98.1%.

Main technical indicators are as follows: the initial current is 12 A, the peak current is 23 A, the electricity consumption of the reduction is 411 Wh, the electricity consumption per ton of lead is 1094 kWh, the lead recovery rate is 99.9%, and the ammonia water consumption is 300 mL (containing 25%-28% of $NH_3$).

Embodiment 3

(1) two pieces of titanium mesh coated with iridium-ruthenium coating are used as an anode, and the anode has a width of 10 cm and a height of 20 cm;

(2) a piece of stainless steel is used as a cathode, and the cathode has a width of 10 cm and a height of 20 cm;

(3) loading: 1000 g of lead chloride, containing 64.3% of Pb and 22.4% of Cl are loaded;

(4) preparation of an electrolyte: 5 L of 2 mol/L ammonium sulfate solution is taken, and 200 mL of ammonia water is added;

(5) reduction: the reduction reaction is carried out in a constant pressure mode with a voltage of 2.0 V for 20 hours; the pH is controlled to 8-9 with ammonia water; and when the reduction is completed, the lead obtained after reduction is taken out from the electrolytic bath; and (6) the lead obtained after reduction subjected to the process of briquetting has a weight of 656.2 g, and the analysis result of the lead sample shows the content of Pb is 98.5%.

Main technical indicators are as follows: the initial current is 10 A, the peak current is 21.8 A, the electricity consumption of the reduction is 336 Wh, the electricity consumption per ton of lead is 523 kWh, the anode current density is 250-545 A/m$^2$, the lead recovery rate is 99.8%, and the ammonia water consumption is 890 mL (containing 25%-28% of $NH_3$).

The foregoing descriptions are merely preferred embodiments of the present invention, which are not used to limit the present invention. Any modifications, equivalent substitutions, improvements within the spirit and principle of the present invention should be included in the protective scope of the present invention.

What is claimed is:

1. A process for preparing lead by electroreduction with an ammonium sulfate and an ammonia, wherein in the process, an ammonium sulfate aqueous solution is used as an electrolyte, a lead compound is used as a raw material, a titanium is used as an anode, a stainless steel or a lead is used as a cathode, and a direct-current electric field is applied in an electrolytic bath; the lead compound is reduced to a metal lead after obtaining electrons at the cathode; at the anode, the ammonia is oxidized to nitrogen for escaping, and $H^+$ ions are generated simultaneously; sulfate radical ions and chloride ions in the lead compound enter the electrolyte and react with ammonia water to form ammonium sulfate and ammonium chloride; and lead monoxide and lead dioxide in the lead compound are reduced to the metal lead, and $OH^-$ ions are simultaneously released to combine with the $H^+$ ions generated at the anode to form water.

2. The process for preparing the lead by the electroreduction with the ammonium sulfate and the ammonia according to claim 1, comprising the following steps:

(1) loading: loading the lead compound on a cathode frame;

(2) preparation of the electrolyte: adjusting a concentration of the electrolyte;

(3) reduction: applying the direct-current electric field in the electrolytic bath, resulting in that the lead compound is directly reduced to the metal lead after obtaining electrons at the cathode, and $H^+$ ions are generated at the anode during the reduction, resulting in that a pH value of the electrolyte is decreased; and then adding the ammonia water to control the pH value of the electrolyte;

(4) taking out from the electrolytic bath: after completing the reduction, lifting the cathode and taking out the metal lead, and remaining a waste electrolyte;

(5) briquetting: briquetting the metal lead to remove moisture from the metal lead to obtain lead briquettes;

(6) smelting, casting, and ingotting: smelting, casting, and ingotting the lead briquettes into lead ingots; and (7) treatment of the waste electrolyte: recovering the sulfate radical ions and the chloride ions released from the lead compound at the cathode in a form of ammonium sulfate or ammonium chloride.

3. The process for preparing the lead by the electroreduction with the ammonium sulfate and the ammonia according to claim 2, wherein the lead compound comprises lead chloride, lead sulfate, lead monoxide, lead dioxide and mixtures thereof.

4. The process for preparing the lead by the electroreduction with the ammonium sulfate and the ammonia according to claim 1, wherein the electrolyte is the ammonium sulfate.

5. The process for preparing the lead by the electroreduction with the ammonium sulfate and the ammonia according to claim 1, wherein an anode plate constituting the anode is a titanium mesh, and a cathode plate constituting the cathode comprises a stainless steel plate or a lead plate.

6. The process for preparing the lead by the electroreduction with the ammonium sulfate and the ammonia according to claim 5, wherein the titanium mesh is a titanium mesh coated with an iridium-ruthenium coating.

7. The process for preparing the lead by the electroreduction with the ammonium sulfate and the ammonia according to claim 4, wherein the ammonium sulfate has a concentration of 0.5-4 mol/L.

8. The process for preparing the lead by the electroreduction with the ammonium sulfate and the ammonia according to claim 2, wherein in the step (3), a voltage for the reduction is 2.0-2.7 V, a current density is 100-500 $A/m^2$, and the pH value is controlled to 6-9 with the ammonia water.

9. The process for preparing the lead by the electroreduction with the ammonium sulfate and the ammonia according to claim 4, wherein the waste electrolyte in the step (7) comprises an ammonium sulfate solution.

10. The process for preparing the lead by the electroreduction with the ammonium sulfate and the ammonia according to claim 2, wherein the electrolyte is the ammonium sulfate.

11. The process for preparing the lead by the electroreduction with the ammonium sulfate and the ammonia according to claim 2, wherein an anode plate constituting the anode is a titanium mesh, and a cathode plate constituting the cathode comprises a stainless steel plate or a lead plate.

12. The process for preparing the lead by the electroreduction with the ammonium sulfate and the ammonia according to claim 11, wherein the titanium mesh is a titanium mesh coated with an iridium-ruthenium coating.

13. The process for preparing the lead by the electroreduction with the ammonium sulfate and the ammonia according to claim 10, wherein the ammonium sulfate has a concentration of 0.5-4 mol/L.

14. The process for preparing the lead by the electroreduction with the ammonium sulfate and the ammonia according to claim 10, wherein the waste electrolyte in the step (7) comprises an ammonium sulfate solution.

* * * * *